US007677302B2

(12) United States Patent
Ehtesham et al.

(10) Patent No.: US 7,677,302 B2
(45) Date of Patent: Mar. 16, 2010

(54) SPOOLABLE CONNECTOR

(75) Inventors: Muhammad Asif Ehtesham, Duncan, OK (US); Robert Pipkin, Marlow, OK (US); Robert Gordon Howard, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 371 days.

(21) Appl. No.: 11/622,244

(22) Filed: Jan. 11, 2007

(65) Prior Publication Data

US 2008/0169094 A1 Jul. 17, 2008

(51) Int. Cl.
*E21B 17/00* (2006.01)
*F16L 19/04* (2006.01)
*F16L 15/00* (2006.01)

(52) U.S. Cl. ..... 166/77.2; 166/242.6; 166/384; 285/382.1; 403/343

(58) Field of Classification Search ..... 166/77.2, 166/242.6, 242.7, 384; 285/114, 115, 116, 285/382.1, 382.2, 307; 403/343, 306
See application file for complete search history.

(56) References Cited

U.S. PATENT DOCUMENTS

| | | | | |
|---|---|---|---|---|
| 4,184,871 | A | 1/1980 | Oba et al. | 430/70 |
| 5,238,273 | A | 8/1993 | Laflin et al. | 285/119 |
| 5,248,151 | A | 9/1993 | Pickup | 473/585 |
| 5,251,695 | A | 10/1993 | Coronado | 166/242.6 |
| 5,285,851 | A | 2/1994 | Pringle | 166/326 |
| 5,306,050 | A | 4/1994 | Laflin et al. | 285/119 |
| 5,411,085 | A | 5/1995 | Moore et al. | 166/242.2 |
| 5,515,880 | A | 5/1996 | Pringle | 137/155 |
| 6,192,983 | B1 | 2/2001 | Neuroth et al. | 166/250.15 |
| 6,367,557 | B1 | 4/2002 | Rosine et al. | 166/384 |
| 6,474,701 | B1 | 11/2002 | Bowles et al. | 285/382.1 |
| 6,481,498 | B1 | 11/2002 | Ackroyd et al. | |

(Continued)

FOREIGN PATENT DOCUMENTS

| | | |
|---|---|---|
| EP | 1460236 | 3/2004 |

(Continued)

OTHER PUBLICATIONS

SPE 94163 Large-Diameter Coiled Tubing Becomes Available Safely Offshore Through a Newly Developed Spoolable Connector: Case Histories and Field Implementation; L. Link, SPE, and L. Laun, SPE, BJ Services A/S; K.T. Nesvik, SPE, Statoil ASA; and H. Boge, SPE, ConocoPhillips Norway; SPE/CoTA Coiled Tubing Conference and Exhibition, Apr. 12-13, The Woodlands, Texas; Copyright 2005, Society of Petroleum Engineers, 2005.

(Continued)

*Primary Examiner*—Jennifer H Gay
*Assistant Examiner*—Yong-Suk Ro
(74) *Attorney, Agent, or Firm*—John W. Wustenberg; Baker Botts, LLP

(57) ABSTRACT

A spoolable connector which connects two opposing sections of coil tubing so as to transmit load between one section of coil tubing and another section of coil tubing. The spoolable connector has opposing non-circular grooves into which portions of the sections of coil tubing are deformed so as to create the torque transmitting connection between the spoolable connector and sections of coil tubing. The spoolable connector also includes a plurality of parallel radial slots on each opposing end to enhance bending of the connector at the ends as well as a plurality of longitudinal slots at each end to accommodate the weld seam line in the coil tubing. Seals may be installed as a sleeve which in use fits over the mid-section of the connector.

35 Claims, 5 Drawing Sheets

U.S. PATENT DOCUMENTS

| | | | | |
|---|---|---|---|---|
| 6,561,278 | B2 | 5/2003 | Restarick et al. | 166/378 |
| D476,731 | S | 7/2003 | Cise et al. | D24/110 |
| 6,712,150 | B1 | 3/2004 | Misselbrook et al. | 166/384 |
| 6,890,007 | B1 | 5/2005 | Parker | 285/354 |
| 7,059,881 | B2 | 6/2006 | Song et al. | 439/191 |
| 2003/0226667 | A1 | 12/2003 | Hill | 166/384 |
| 2004/0184871 | A1 | 9/2004 | Luft et al. | 403/300 |
| 2005/0248151 | A1 | 11/2005 | Connell | 285/286.2 |
| 2006/0157974 | A1 | 7/2006 | Luft et al. | |
| 2006/0243453 | A1 | 11/2006 | McKee | 166/380 |
| 2007/0000669 | A1 | 1/2007 | McKee et al. | 166/380 |
| 2007/0235198 | A1 | 10/2007 | Parker | |
| 2008/0047716 | A1 | 2/2008 | McKee et al. | |

FOREIGN PATENT DOCUMENTS

| | | |
|---|---|---|
| GB | 2314391 | 1/1997 |
| GB | 2340574 | 4/1997 |
| GB | 2369634 | 11/2001 |
| WO | WO97/41377 | 4/1997 |

OTHER PUBLICATIONS

SPE 35590 Lessons Learned on Coiled Tubing Completions, Stephens, R.K., Loveland, K.R., BP Exploration (Alaska) Inc.; Witlow, R.R., Melvan, J.J., Orbis Engineering; SPE Gas Technology Symposium, Apr. 28-May 1, Calgary, Alberta, Canada; Copyright 1996, Society of Petroleum Engineers, Inc., 1996.

SPE 89527 Development of a New Spoolable Mechanical Coiled Tubing Connector, H.B. Luft, L.E. Laun, P.B. Thov, BJ Services Company Canada; SPE/CoTA Coiled Tubing Conference and Exhibition, Mar. 23-24, Houston, Texas; Copyright 2004, Society of Petroleum Engineers, 2004.

SPE 46053 Applications Update—Advanced Composite Coiled Tubing, Fowler, S.H., Fiberspar Spoolable Products, Inc.; Feechan, M., Berning, S.A., Halliburton Energy Services, Inc.; SPE/CoTA Coiled Tubing Roundtable, Mar. 15-16, Houston, Texas; Copyright 1998, Society of Petroleum Engineers, 1998.

SPE 40031 Composite Coiled Tubing in Harsh Completion/Workover Environments, Rispler, K., Berning, S., Halliburton Energy Services, Inc; Fowler, H. Fiberspar Spoolable Products, Inc.; SPE Gas Technology Symposium, Mar. 15-18, Calgary, Alberta, Canada; Copyright 1998, Society of Petroleum Engineers Inc., 1998.

SPE 26538 A Spoolable Coiled-Tubing Gas-Lift Completion System, Walker, E.J., Hendrix, J.L., Humphrey, K.J., BP Exploration (Alaska) Inc.; Moore, B.K., Nowcam Services Inc.; Whitlow, R.R., Orbis Engineering Inc.; SPE Annual Technical Conference and Exhibition, Oct. 3-6, Houston, Texas; Copyright 1993, Society of Petroleum Engineers, Inc., 1993.

SPE 94159 World's First Utilization of Coiled Tubing to Dissolve Hydrate(s) in an FPSO Riser; Case History, M. Ovesen, SPE, and L. Laun, SPE, BJ Services A/S, and H. Varhaug, SPE, and K.T. Nesvik, SPE, Statoil ASA; SPE/CoTA Coiled Tubing Conference and Exhibition, Apr. 12-13, The Woodlands, Texas; Copyright 2005, Society of Petroleum Engineers, 2005.

SPE 54316 First Diverless Subsea Wireline Well Intervention Performed in Offshore Vietnam Offers Low-Cost Solution for Light Well Workovers: Case Histories and Future Trends, David Larimore, SPE; Halliburton Energy Services, Inc., Charles Ashwell, Brown & Root Energy Services; Abdul Halim Zainal Abidin, Petronas Carigali (Vietnam) SDN BHD; SPE Asia Pacific Oil and Gas Conference and Exhibition, Apr. 20-22, Jakarta, Indonesia; Copyright 1999, Society of Petroleum Engineers, 1999.

SPE 89335 Tapered OD Coiled Tubing System, Mark Kalman, Bob Domann, Randy Rosine, Halliburton; Rodney Stephens, Michael Chambers, BP; John Martin, Quality Tubing; David McWhorter, Texas Oil Tools; SPE/ICoTA Coiled Tubing Conference and Exhibition, Mar. 23-24, Houston, Texas; Copyright 2004, Society of Petroleum Engineers, 2004.

SPE 60734 Composite Coiled Tubing Solution, Terry K Wheaton, Scott A. Berning, Dick Headrick, Mike Feechan, Clint Isenrock, Halliburton Energy Services, Inc.; Stewart H. Fowler, Fiberspar, Inc. Spoolable Products; SPE/ICoTA Coiled Tubing Roundtable, Apr. 5-6, Houston, Texas; Copyright 2000, Society of Petroleum Engineers Inc., 2000.

SPE 60730 Development of a Power and Data Transmission Thermoplastic Composite Coiled Tubing for Electric Drilling, G.P. Kamp, Airborne Development; M. Betts, SPE, Shell International Exploration and Production B.V.; SPE/ICoTA Coiled Tubing Roundtable, Apr. 5-6, Houston, Texas; Copyright 2000, Society of Petroleum Engineers, 2000.

SPE 89600 New Technologies Allow Small Coiled Tubing to Complete the Work Formerly Reserved for Large Coiled Tubing Units, Lance Portman, BJ Services; SPE/ICoTA Coiled Tubing Conference and Exhibition, Mar. 23-24, Houston, Texas; Copyright 2004, Society of Petroleum Engineers, 2004.

SPE 54507 Applications Engineering for Composite Coiled Tubing, D.W. McClatchie, BJ Services Co.; H.A. Reynolds, T.J. Walsh, C. Lundberg, Hydril Co.; SPE/ICoTA Coiled Tubing Roundtable, May 25-26, Houston, Texas; Copyright 1999, Society of Petroleum Engineers Inc., 1999.

SPE 29781 Coiled Tubing Completions; An Economic Discussion of Procedures, Courville, Perry W., Clark, Thomas R., Halliburton Energy Services; Middle East Oil Show, Mar. 11-14, Bahrain; Copyright 1995, Society of Petroleum Engineers, Inc., 1995.

SPE 89348 Coiled Tubing and Wireline Intervention for Well Abandonment, S. Kirby, BP; G. Skelly, Team Energy; D. Gordon, S. Sheed, Weatherford Wellserv; SPE/ICoTA Coiled Tubing Conference and Exhibition, Mar. 23-24, Houston, Texas; Copyright 2004, Society of Petroleum Engineers, 2004.

SPE 26086 Emerging Coiled-Tubing Applications at Prudhoe Bay, Alaska, Blount, C.G., Ward, S.L., ARCO Alaska Inc.; Hightower, C.M., ARCO E and P Technology; Walker, E.J., BP Exploration (Alaska) Inc., SPE Western Regional Meeting, May 26-28, Anchorage, Alaska; Copyright 1993, Society of Petroleum Engineers, Inc., 1993.

SPE 71056 Packers Designed for Coiled Tubing Completions, Recompletions, and Stimulation, W. Sid Scott, Petro-Tech Tools, A Division of Schlumberger; SPE Rocky Mountain Petroleum Technology Conference, May 21-23, Keystone, Colorado; Copyright 2001, Society of Petroleum Engineers Inc., 2001.

SPE 29358 Steps Towards a Comprehensive Reeled Tube Drilling System, Faure, A.M., Peter Oosterling, Lord, D.J., Shell Research B.V.; Vuuinghs, Pieter, Petroleum Development Oman; Brinkhorst, Jan, BEB Erdol Erdgas GmBH; SPE/IADC Drilling Conference, Feb. 28-Mar. 2, Amsterdam, Netherlands; Copyright 1995, SPE/IADC Drilling Conference, 1995.

http://www.oilonline.com/news/features/oe/20041001.The_reel.16032.asp—describes BJ Services Spoolable Connector (Duralink) Efforts with the Misselbrook spin.

http://www.spe.no/bergen/doc/one_day_seminar_04/pdf_disc/troldtog/8%20Developement%20of%20a%20new%20spoolable%20mechanical%20CT%20connector.pdf—BJ Presentation in Norway on Duralink.

http://www.iadc.org/dcpi/dc-julaug05/July05-coiled.pdf, , Another article on BJ's Duralink.

http://www.slb.com/media/services/coiled/tools/ezspliceconnector.pdf—Schlumberger's EZ Splice Connector.

http://www.ctes.com/Services/custom/Generic%20Detailed%20CT%20Manual%20TOC.pdf—CTES Manual index on the web—see Chapter 5—connectors.

Coiled Tubing Tools Manual "Connectors" dated Aug. 2004.

Foreign communication related to a counterpart application dated May 27, 2008.

SPOOLABLE CONNECTOR

FIELD OF THE INVENTION

The present invention relates generally to connectors for coil tubing and more specifically to a spoolable connector which joins and seals adjacent tubing sections so as to allow loads and fluids to be transmitted between such tubing sections.

BACKGROUND

Coil tubing is primarily used to perform various down hole operations in oil and gas wells. The depth of the well can be many thousands of feet which makes the continuous coil tubing reel very heavy and in some situations impossible to move in one piece. In offshore rigs, the weight of the coil tubing reel is limited by crane capability and other logistical issues related to the harsh working environment, which requires the coil tubing to be transported in two or three reels. Conventional methods of joining coil tubing requires a certified welder to weld two ends of coil tubing together without significantly de-rating the fatigue limit of the coil tubing, which is in the range of 30-40% for a manual butt weld. However, certified welders are very expensive and not always readily available. The equipment needed to insure a high integrity weld is also expensive and not always readily available. Furthermore, the weather conditions can make the welding operation a significant challenge.

There are several coil tubing connectors on the market which have attempted to address some of these issues. A dimple connector of the type shown in U.S. Pat. No. 6,474,701 is one example of such a connector. It uses a dimpling method to join two ends of the coil tubing to a central connector. The center of the connector is formed with radial slots filled with elastomeric pieces. The dimple connector has an acceptable fatigue life and exhibits a good tensile strength, however, the elastomeric material is not suitable in all fluid environments. Furthermore, this design requires a hydraulic dimpling tool on location.

A simple roll-on type connector has also been proposed. However, such connectors do not have a good torque rating and hence are not practical for joining two ends or sections of coil tubing. Other connectors, such as slip connectors and splined connectors, are not spoolable and therefore are also not practical for joining spoolable coil tubing.

Therefore, there is a need in the coil tubing industry for a connector which has approximately the strength of the base coil tubing, can be spooled easily on a reel with sufficient fatigue life for multiple spooling/unspooling operations, requires minimal equipment and time to install, and has sufficient torque imparting characteristics for typical coil tubing operations.

SUMMARY

In one embodiment, the present invention is directed to a spoolable connector, which connects two sections of coil tubing. The spoolable connector is defined by a generally cylindrical main body having a mid-section and opposing ends. In one embodiment, the main body is integrally formed as a unitary part. The spoolable connector includes means for enhancing the application of torque to the spoolable connector by the sections of the coiling tubing. In one embodiment, the torque enhancing means includes non-circular grooves formed in the main body, wherein at least one of the grooves is disposed adjacent to one end of the main body and at least another groove is disposed adjacent to another end of the main body. As defined herein a "non-circular" groove includes any groove which extends less than 360° around the circumference of an object as well as any non-closed end groove (e.g., a helical groove) which extends around the circumference of an object. Furthermore, although the grooves shown and described herein are generally semi-circular shaped, they may assume any shape, including but not limited to square, parabolic, etc. The torque enhancing means may also include conventional securing arrangements, such as dimple connections.

A portion of each end of the coiled tubing is pressed into an interference fit with one of the non-circular grooves in the main body of the connector. In another embodiment, the torque enhancing means includes one or more helical grooves formed in the main body, one of which being formed in one opposing end and the other being formed in the other opposing end.

In one embodiment, the spoolable connector according to the present invention has at least one radial slot formed in each of its opposing ends. Each of the radial slots extends partially around the circumference of the main body. In one embodiment, each of the ends of the spoolable connector has a plurality of longitudinal grooves formed there along equally spaced from one another around the circumference of the main body. In one embodiment, the spoolable connector further includes a generally cylindrical sleeve which in use fits over at least a portion of a mid-section of the main body.

In another embodiment, the present invention is directed to a spoolable connector, which includes a main body having two opposing ends and a mid-section, wherein one of the opposing ends has a first outer diameter, the other opposing end as a second outer diameter, and the mid-section has an outer diameter which tapers between the first outer diameter and the second outer diameter. This embodiment of the spoolable connector in accordance with the present invention may be used with Halliburton's Deep Reach™ coil tubing of different diameters. This embodiment may also be used to join coil tubing sections of constant outer diameter and differing wall thicknesses. It may also be used to join coil tubing sections of constant outer diameter and wall thickness which varies over the length, such as Quality Tubing's TruTaper™ coil tubing.

BRIEF DESCRIPTION OF THE DRAWINGS

The following drawings form part of the present specification and are included to further demonstrate certain aspects of the present invention. The present invention may be better understood by reference to one or more of these drawings in combination with the description of embodiments presented herein. However, the present invention is not intended to be limited by the drawings.

DETAILED DESCRIPTION

Figure 1:
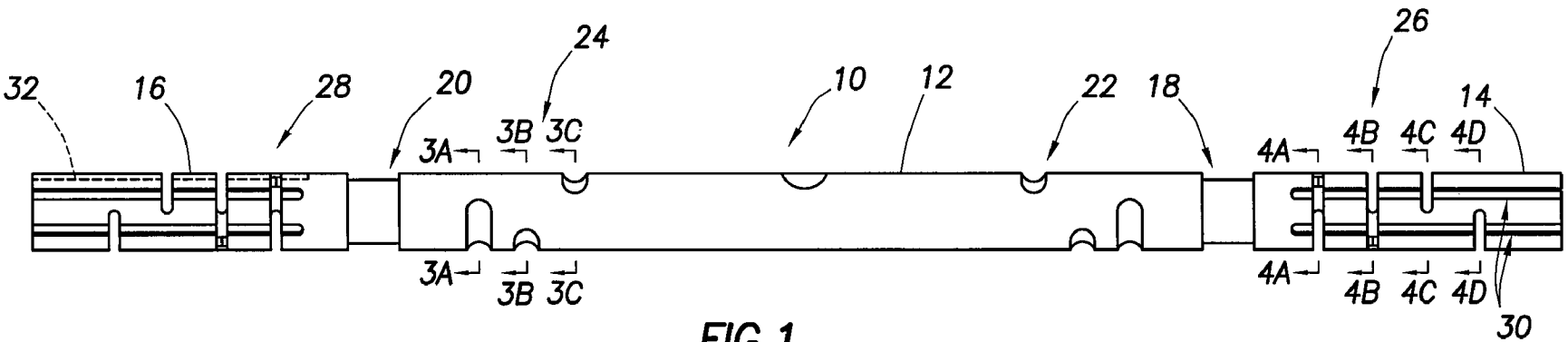
FIG. 1 is a schematic diagram illustrating the spoolable connector according to the present invention.

The present invention will now be described with reference to the following exemplary embodiments. Referring now to FIG. 1, a spoolable connector in accordance with the present invention is shown generally by reference number 10. The spoolable connector connects two sections of a coil tubing (not shown). The spoolable connector 10 is generally cylindrical in shape and formed of a metal alloy such as AISI-SAE 4130 Modified, but as those of ordinary skill in the art will appreciate other suitable metals or materials may be used to form the spoolable connector so as to give it its desired tensile and fatigue strength yet make it ductile enough to bend. The spoolable connector 10 is defined by a main body having a mid-section 12 and opposing ends 14 and 16. The spoolable connector 10 further includes a pair of circular grooves 18 and 20 formed in the mid-section 12 of the main body.

One of the circular grooves 18 is disposed adjacent to opposing end 14 of the main body and the other circular groove 20 is disposed adjacent to opposing end 16 of the main body. A generally circular or ring-shaped seal (not shown) fits within the circular groove 18 in use (i.e., when the connector is installed). The seal prevents fluids from flowing into or out of the coil tubing connection. A second generally circular or ring-shaped seal fits within the circular groove 20 in use and also performs the function of sealing the respective corresponding section of coil tubing to the connector thereby preventing fluid from flowing into or out of the coil tubing connection. The seals, generally circular (e.g., O-ring shaped), V-ring shaped, molded on or bonded and machined may be formed of rubber, elastomer, a soft metal, or other suitable material with or without backups formed of metal, plastic or any combination of these, which prevents fluids from flowing into and out of sections of the coil tubing. The circular grooves 18 and 20 are machined into the main body of the spoolable connector 10 using conventional machining techniques. As those of ordinary skill in the art will appreciate more or less seals and corresponding grooves may be provided depending upon the application and environment. For example, one, two or more circular grooves may be provided of differing width and depth on each end 14, 16 of the connector 10 or alternatively one in the mid-section 12.

In one embodiment, the spoolable connector 10 further comprises opposing sets of partial grooves 22 and 24 formed at opposing ends of the mid-section 12 of the main body. One of the opposing sets of grooves 22 is disposed adjacent to the circular groove 18. The other opposing set of partial grooves 24 is disposed adjacent the other circular groove 20. Each of these partial grooves extends approximately 30° to 270° around the circumference of the main body and are off-plane from an adjacent partial groove. The invention contemplates one or more partial grooves in each opposing end. In one embodiment, the partial grooves nearest the opposing ends 14 and 16 have a greater depth than those nearest the mid-section 12. The intermediate partial grooves have intermediate depths. In one exemplary embodiment, there are three partial grooves, each of which extends 180° around the circumference of the main body and is 60° out of phase from an adjacent partial groove. In one exemplary embodiment, the partial grooves nearest the opposing ends 14 and 16 have a depth of approximately 0.14 inches. The partial grooves nearest the mid-section 12 have a depth of approximately 0.12 inches and the intermediate partial grooves have a depth of approximately 0.13 inches. The partial grooves closest to the mid-section have a lesser depth because the stresses on the connector in that region are greater. More specifically, the stresses on the spoolable connector 10 decrease the further away from the mid-section of the connector the partial groove is located. In one exemplary embodiment, the distance between the partial grooves nearest the mid-section 12 from each other is 4 inches or greater. Distances of 4 inches or greater enable greater bending of the spoolable connector 10 around the spool. As those of ordinary skill in the art will appreciate, the number, length, depth and exact orientation of the partial grooves may be varied. In an alternate embodiment, rather than having one or more partial grooves disposed at the adjacent ends of the mid-section 12 of the main body, a helical groove is provided at each such end. In yet another embodiment, a simple roll-on or dimple connection may be formed.

In one embodiment, the pair of opposing sets of partial grooves 22 and 24 mate with crimped sections of the opposing sections of coil tubing. A crimping tool known in the art is used to deform the coil tubing into the sets of partial grooves 22 and 24. A crimpling tool is a C-shaped pipe cutting tool with the cutting wheel replaced with a roller indenter. The roller indenter has dimensions matching the groove dimensions on the connector. The crimping tool is placed over the coil tubing which in turn is slid over the spoolable connector 10 with the roller indenter positioned in the center of the machined groove on the connector-coil tube assembly. The crimping tool has a screw-type feed mechanism, which presses the sections of coil tube as the roller indenter is pushed against it. Because the sets of partial grooves 22 and 24 do not extend around the entire circumference of the spoolable connector 10, the sections of coil tubing do not rotate relative to the spoolable connector thereby enabling the spoolable connector to effectively transmit torque between the two opposing sections of coil tubing. The ungrooved portions of the spoolable connector main body adjacent the partial grooves act to constrain rotation thereby enabling the connector to effectively transmit torque between the opposing sections of coil tubing. The partial grooves 22 and 24 are machined into the main body of the spoolable connector 10 using conventional machining techniques.

Figure 3B:
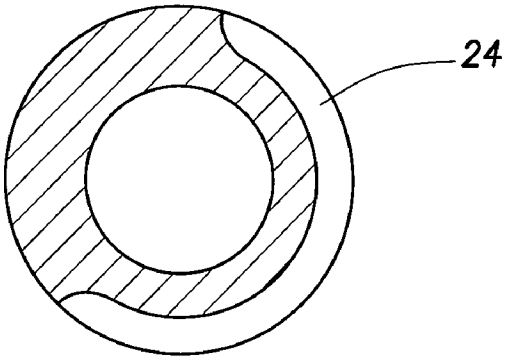
FIGS. 3A-3C are cross-sectional views of the spoolable connector taken along lines 3A-3A, 3B-3B, and 3C-3C, respectively, in FIG. 1 illustrating cross-sections of one set of partial grooves.
Figure 3A:
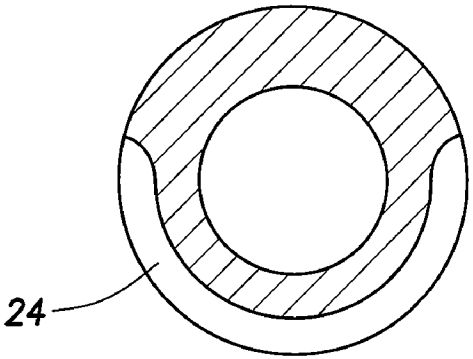
Figure 3C:
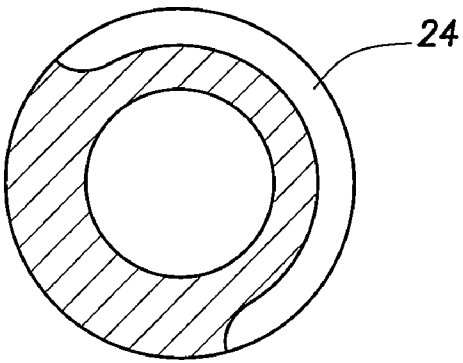
Figure 4B:
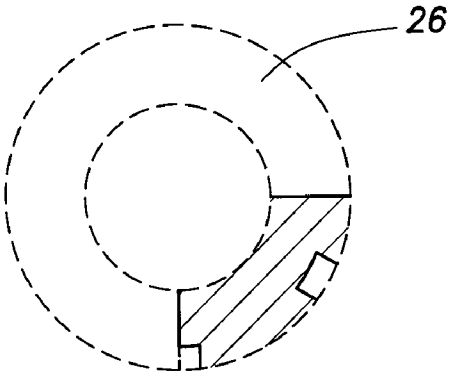
FIGS. 4A-4D are cross-sectional views of the spoolable connector taken along lines 4A-4A, 4B-4B, 4C-4C and 4D-4D, respectively, in FIG. 1 illustrating cross-sections of one set of partial grooves.
Figure 4D:
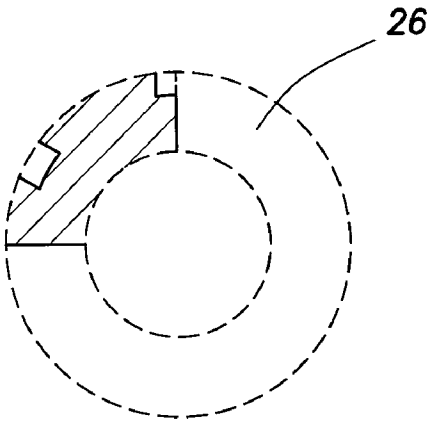
Figure 4A:
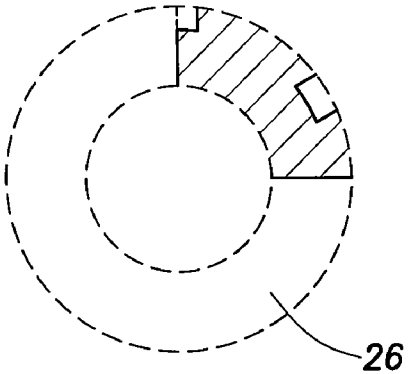
Figure 4C:
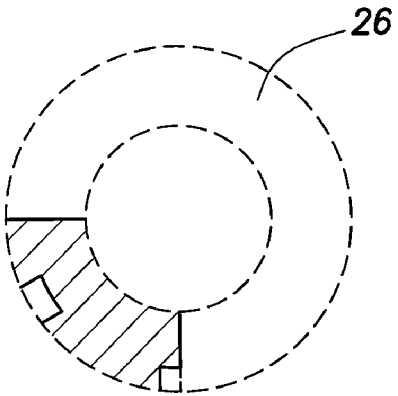

FIGS. 3A, B, and C show cross sections of the partial grooves 24 taken along lines 3A-3A, 3B-3B and 3C-3C, respectively, The shaded portions indicated in FIGS. 3A-C illustrate the part of opposing end 14 where the radial slot does not extend. As those of ordinary skill in the art will appreciate, alternate configurations of the partial grooves in terms of their number and orientation may be used. As those of ordinary skill in the art will appreciate, the number and configuration of partial grooves 22 and 24 may be modified depending upon the desired torsional performance of the spoolable connector 10 in other design configurations.

Figure 2:
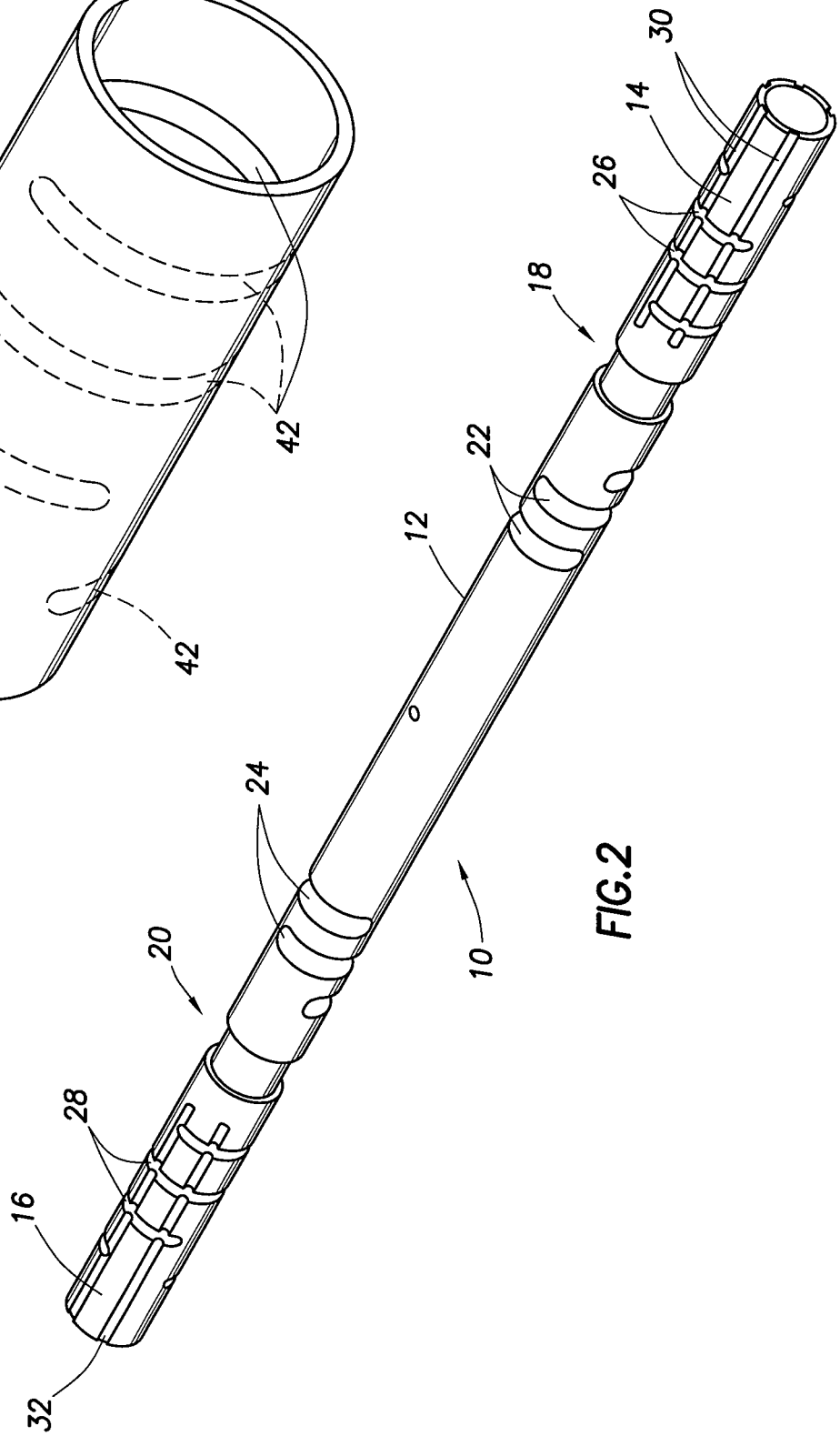
FIG. 2 is a perspective view of the spoolable connector shown in FIG. 1.

The spoolable connector 10 further has at least one, and in at least one embodiment, a plurality of radial slots 26 and 28 disposed on each of the opposing ends 14 and 16, respectively. Each of the plurality of radial slots 26 and 28 extends partially around the circumference of the main body of the spoolable connector 10. In one embodiment, each of the opposing ends 14 and 16 has four radial slots each of which extends approximately 270° around the circumference of the main body and is 90° out of phase from an adjacent radial slot. FIG. 2 shows a perspective view of the spoolable connector 10 illustrating the opposing pairs of circular grooves 18 and 20, the opposing sets of partial grooves 22 and 24 and the opposing radial slots 26 and 28.

The cross sections of the opposing sets of radial slots are shown in FIGS. 4A-4D which correspond to cross sections taken through lines 4A-4A, 4B-4B, 4C-4C, 4D-4D. In each of FIGS. 4A-4D, respectively, the cross-haired sections illustrate the portions of the main body where material has not been removed. The radial slots 26 and 28 are provided to weaken the ends 14 and 16 so as to allow them to bend more easily and thereby conform to the shape of the coil tubing adjacent to the connector on each end as it is spooled. Furthermore, unlike externally tapered connectors, such as those illustrated in U.S. Patent Publication 2006/0243453, the spoolable connector with radial slots 26 and 28 does not bend eccentrically relative to the coil tubing. Rather, the radial slots 26 and 28 enable the connector and adjacent tubing to conform more to the shape of the coil tubing further from the connector as it is being spooled. Concentric, uniform support of the tubing by the connector also minimizes local ovalization of the tubing during spooling. The more uniform spooling diameter and reduction in local ovalization both contribute to improved fatigue life of both the connector and adjacent tubing. The radial slots 26 and 28 are machined into the opposing ends of the spoolable connector 10 using conventional machining techniques.

Each of the opposing ends 14 and 16 further include a plurality of longitudinal grooves 30 and 32 formed along each of said opposing ends. In one embodiment according to the present invention, each of the opposing ends 14 and 16 has multiple longitudinal grooves formed there along equally spaced from one another around the circumference of the main body. In one exemplary embodiment, six equally-spaced longitudinal grooves 30 and 32 are provided. The longitudinal grooves 30 and 32 accommodate the weld seam typically found on the inside surface of the opposing sections of coil tubing. It saves the time and expense of having to remove the weld seam, which is difficult especially for distances greater than six inches. Although only one such seam exists, having multiple longitudinal grooves provides for ease of installation of the opposing sections of coil tubing over the spoolable connector 10 with minimal axial misalignment and therefore decreases the amount of torsional preload applied to the spoolable connector 10. The longitudinal grooves 30 and 32 are machined into the opposing ends of the spoolable connector 10 using conventional machine techniques.

Figure 5:
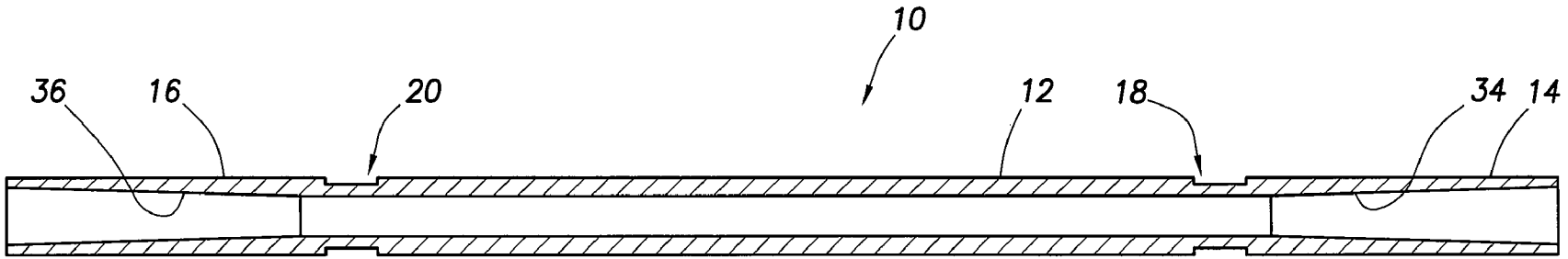
FIG. 5 is a longitudinal cross-sectional view of the spoolable connector illustrating its internal tapered ends.

Referring now to FIG. 5, a longitudinal cross section of the spoolable connector 10 is shown. As can be seen from FIG. 5, the main body of the spoolable connector 10 is substantially hollow with the mid-section 12 being the thickest portion of the spoolable connector 10. The mid-section 12 is the thickest portion of the main body because as noted above that is the section of the spoolable connector 10 which carries the greatest load when the coil tubing is wound around the spool. The opposing ends 14 and 16 of the main body of the spoolable connector 10 each have an internal taper which terminates at the approximate mid-section 12 as indicated by reference numbers 34 and 36, respectively. Also illustrated in FIG. 5, the main body of the spoolable connector 10 is integrally formed as a unitary part. Although as those of ordinary skill in the art will appreciate, the main body can be formed by multiple components which have been welded together or otherwise connected.

Figure 6:
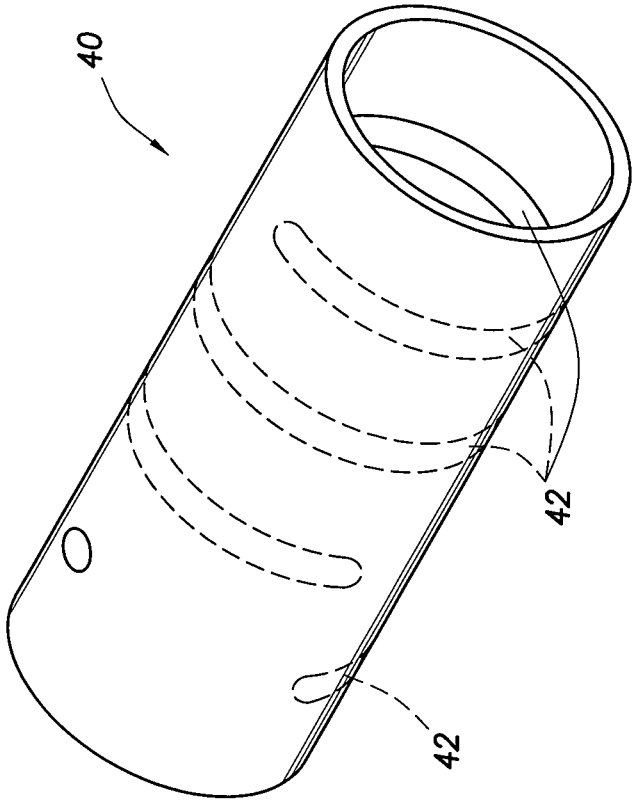
FIG. 6 is a perspective view of a sleeve adapted to slide over the mid-section of the spoolable connector shown in FIG. 1 in use.

In one embodiment, the spoolable connector 10 further comprises a cylindrical sleeve 40 (shown in FIG. 6) which in use is disposed around the mid-section 12 of the main body. The purpose of the sleeve is to maintain a uniform diameter relative to the adjoining coil tubing. The cylindrical sleeve 40 includes a plurality of radial grooves 42 formed on the inner circumferential surface of the sleeve 40. In one embodiment, four radial grooves are provided. Each of the radial grooves 42 extends approximately 270° around the circumference of the sleeve and is 90° out of phase from the adjacent radial groove. The radial grooves 42 enable the sleeve 40 to bend as the spoolable connector 10 and associated coil tubing sections are wrapped around the spool. In one alternate embodiment, a helical groove is formed on the inner circumferential surface of the cylindrical sleeve 40. The cylindrical sleeve 40 is not a fluid containing component. As those of ordinary skill in the art will appreciate, alternative configurations which have a different number and orientation of grooves 42 may be provided depending upon the loading characteristics that the sections of coil tubing will experience.

As those of ordinary skill in the art will appreciate, the spoolable connector 10 has many applications. Once such application includes connecting two sections of coil tubing having the same diameter and wall thickness. The spoolable connector can also join two sections of coil tubing of different diameters and/or different wall thicknesses. Coil tubing which has differing wall thickness includes taper coil tubing. Taper coil tubing has a tapered section which reduces the wall thickness from one size to another. The spoolable connector 10 can be used without modification to connect to two sections of taper coil tubing. The spoolable connector 10 can also be used to connect Deep Reach™ coil tubing, which is coil tubing of two different sizes. As those of ordinary skill in the art will appreciate, the spoolable connector 10 would have to be modified to work in such a connection.

Figure 7:
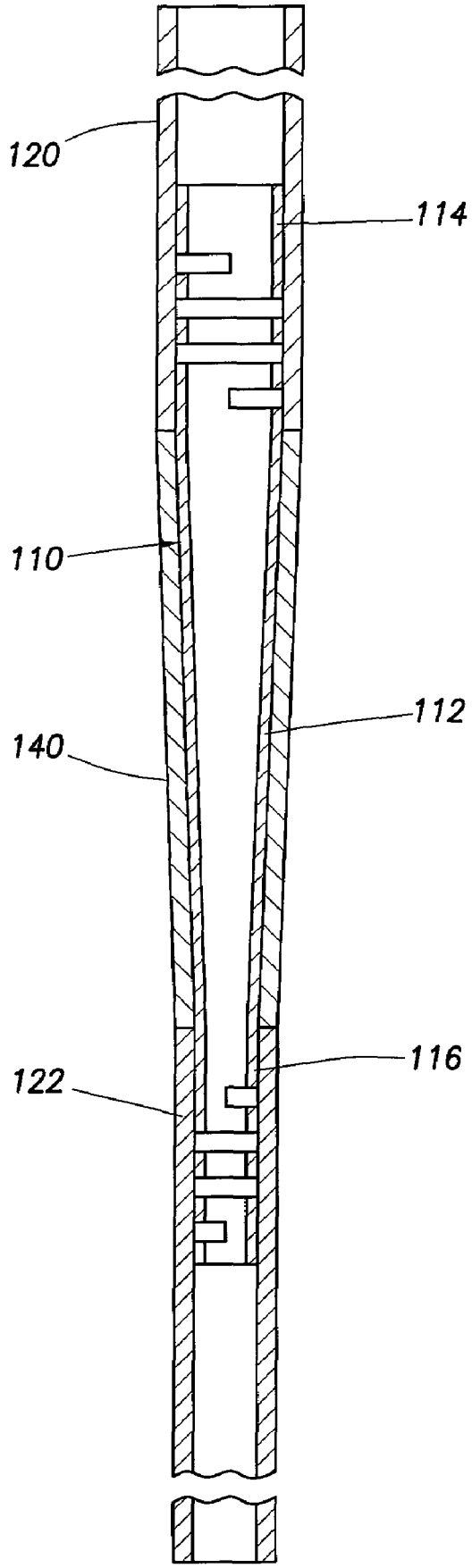
FIG. 7 illustrates another embodiment of the spoolable connector in accordance with the present invention, which is configured to connect two sections of coil tubing of different diameters.

FIG. 7 illustrates a modified embodiment of the spoolable connector in accordance with the present invention which is identified generally by reference numeral 110. In this embodiment, the spoolable connector 110 has a mid-section 112 and opposing ends 114 and 116. Opposing end 114 has a first outer diameter and opposing end 116 has a second smaller outer diameter. The mid-section 112 is tapered between the first outer diameter to the second outer diameter. In one embodiment, the opposing end 114 is adapted to fit within a 2 inch diameter outer diameter coil tubing 120 and the opposing end 116 is adapted to fit within a 1.75 inch outer diameter coiling tubing 122. As those of ordinary skill in the art will appreciate, the opposing ends 114 and 116 can be adapted to fit within any size coil tubing. The spoolable connector 110 also includes a tapered sleeve 140 which fits over the mid-section 112 between the two sections of coil tubing. The spoolable connector 110 may incorporate one or more of the other features of the present invention, including the non-circular grooves which form the interference fit with the sections of coiling tubing, the radial slots for adding flexibility to the ends of the connector, the longitudinal grooves for accommodating the weld seam in the coil tubing, and seals for preventing the leakage of fluids between the sections of coil tubing and the spoolable connector. In one exemplary embodiment, the spoolable connector 110 is approximately 8-10 feet in length.

To join two different coil tubing sections of constant outer diameter and different wall thicknesses, the spoolable connector 112 could have the main body 110 tapered such that the outer diameter of the opposing ends 114 and 116 fit within the inner diameter of each of the coil tubing sections being joined, and has an internal taper from one opposing end to the other. The cylindrical sleeve would then have a uniform outer diameter equal to the outer diameter of the coil tubing sections being joined.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A spoolable connector which connects two sections of coil tubing, comprising a generally cylindrical main body having opposing ends;

at least one non-circular groove formed in the main body into which a portion of at least one of the two sections of coil tubing is pressed; and at least one radial slot extending completely through the wall of the main body and which extends partially around the circumference of the main body formed at or proximate to at least one of the opposing ends;

wherein the radial slot weakens the opposing end to conform to shape of a section of coil tubing adjacent to the opposing end.

2. The spoolable connector according to claim 1, wherein a set of non-circular grooves is provided proximate each of the opposing ends wherein a portion of one of the two sections of coil tubing is pressed into one of the sets of non-circular grooves and a portion of the other of the two sections of coil tubing is pressed into the other set of non-circular grooves.

3. The spoolable connector according to claim 2, wherein each of the sets of non-circular grooves comprises three parallel partial grooves each of which extends approximately 180° around the circumference of the main body and is 60° out of phase from an adjacent groove.

4. The spoolable connector according to claim 3, wherein the grooves nearest the ends have a greater depth than those furthest from the ends and the intermediate grooves have intermediate depths.

5. The spoolable connector according to claim 2, wherein the distance between each of the sets of non-circular grooves is approximately 4 inches or greater.

6. The spoolable connector according to claim 1, further comprising two circular grooves formed in the main body, wherein one of the circular grooves is disposed adjacent to one end of the main body and the other circular groove is disposed adjacent to the other end of the main body.

7. The spoolable connector according to claim 6, further comprising seals which in use fit within the circular grooves, wherein each of the seals is selected from the group consisting of an O-ring; and O-ring with a backup; a V-ring; a V-ring with a backup; an elastomer, rubber or soft metal formed to a desired shape; an elastomer, rubber or soft metal formed to a desired shape with a backup and combinations thereof.

8. The spoolable connector according to claim 1, wherein the main body is hollow.

9. The spoolable connector according to claim 1, wherein each of the opposing ends of the main body has an internal taper which terminates proximate a mid-section.

10. The spoolable connector according to claim 1, wherein each of the opposing ends has a plurality of radial slots formed therein, and wherein each of the plurality of slots extends partially around the circumference of the main body.

11. The spoolable connector according to claim 10, wherein each of the opposing ends has four radial slots, each of which extends approximately 270° around the circumference of the main body and is 90° out of phase from an adjacent radial slot.

12. The spoolable connector according to claim 1, wherein one of the opposing ends has a first outer diameter, the other opposing end has a second outer diameter, and the mid-section has an outer diameter which tapers between the first outer diameter and the second outer diameter.

13. The spoolable connector according to claim 1, wherein each of the opposing ends has at least one longitudinal groove formed there along.

14. The spoolable connector according to claim 13, wherein each of the opposing ends has six longitudinal grooves formed there along equally spaced from one another around the circumference of the main body.

15. The spoolable connector according to claim 1, wherein the main body is tapered to accommodate coil tubing sections with constant outer diameters but different wall thicknesses.

16. The spoolable connector according to claim 1, further comprising a generally cylindrical sleeve which in use fits over at least a portion of a mid-section of the main body.

17. The spoolable connector according to claim 16, wherein the cylindrical sleeve comprises a plurality of radial grooves formed on an inner circumferential surface, each of which extends partially around the circumference of the cylindrical sleeve.

18. The spoolable connector according to claim 1, wherein the main body is integrally formed as a unitary part.

19. A spoolable connector which connects two sections of coil tubing, comprising a generally cylindrical main body having opposing ends;

means for enhancing the application of torque to the spoolable connector by the sections of the coiling tubing, wherein the torque enhancing means is formed in the main body; and at least one radial slot extending completely through the wall of the main body and which extends partially around the circumference of the main body formed at or proximate to at least one of the opposing ends;

wherein the radial slot weakens the opposing end to conform to shape of a section of coil tubing adjacent to the opposing end.

20. The spoolable connector according to claim 19, wherein the torque enhancing means comprises a set of non-circular grooves provided proximate each of the opposing ends and wherein a portion of one of the two sections of coil tubing is pressed into one of the sets of non-circular grooves and a portion of the other of the two sections of coil tubing is pressed into the other set of non-circular grooves.

21. The spoolable connector according to claim 20, wherein each of the sets of non-circular grooves comprises at least three parallel grooves, each of which extend partially around the circumference of the main body.

22. The spoolable connector according to claim 21, wherein each of the sets of non-circular grooves comprises three partial grooves each of which extends approximately 180° around the circumference of the main body and is 60° out of phase from an adjacent partial groove.

23. The spoolable connector according to claim 22, wherein the partial grooves nearest the ends have a greater depth than those furthest from the ends and the partial grooves in between have intermediate depths.

24. The spoolable connector according to claim 19, wherein each of the opposing ends has a plurality of radial slots formed therein, and wherein each of the plurality of slots extends partially around the circumference of the main body.

25. The spoolable connector according to claim 24, wherein each of the opposing ends has four radial slots, each of which extends approximately 270° around the circumference of the main body and is 90° out of phase from an adjacent radial slot.

26. The spoolable connector according to claim 19, wherein each of the opposing ends has a plurality of longitudinal grooves formed there along equally spaced from one another around the circumference of the main body.

27. The spoolable connector according to claim 19, further comprising a generally cylindrical sleeve which in use fits over at least a portion of a mid-section of the main body.

28. The spoolable connector according to claim 27, wherein the cylindrical sleeve comprises a plurality of radial grooves formed on an inner circumferential surface, each of which extends partially around the circumference of the cylindrical sleeve.

29. The spoolable connector according to claim 19, wherein the main body is integrally formed as a unitary part.

30. The spoolable connector according to claim 19, wherein one of the opposing ends has a first outer diameter, the other opposing end has a second outer diameter, and the mid-section has an outer diameter which tapers between the first outer diameter and the second outer diameter.

31. The spoolable connector according to claim 19, wherein the main body is tapered to accommodate coil tubing sections with constant outer diameters but different wall thicknesses.

32. A spoolable connector which connects two sections of coil tubing comprising:

a generally cylindrical main body having opposing ends; and at least one radial slot extending completely through the wall of the main body and which extends partially around the circumference of the main body formed at or proximate to at least one of the opposing ends;

wherein the radial slot weakens the opposing end to conform to shape of a section of coil tubing adjacent to the opposing end.

33. The spoolable connector according to claim 32, wherein each of the opposing ends has a plurality of radial slots formed therein, and wherein each of the plurality of slots extends partially around the circumference of the main body.

34. The spoolable connector according to claim 33, wherein each of the opposing ends has four parallel radial slots, each of which extends approximately 270° around the circumference of the main body and is 90° out of phase from an adjacent radial slot.

35. The spoolable connector according to claim 32, wherein the main body is integrally formed as a unitary part.

* * * * *